US012523454B2

(12) United States Patent
Bell, III

(10) Patent No.: US 12,523,454 B2
(45) Date of Patent: Jan. 13, 2026

(54) REMOTE RESETTING SPORTS TARGET

(71) Applicant: Joseph Edward Bell, III, Easton, PA (US)

(72) Inventor: Joseph Edward Bell, III, Easton, PA (US)

( * ) Notice: Subject to any disclaimer, the term of this patent is extended or adjusted under 35 U.S.C. 154(b) by 620 days.

(21) Appl. No.: 18/064,881

(22) Filed: Dec. 12, 2022

(65) Prior Publication Data

US 2024/0191977 A1 Jun. 13, 2024

(51) Int. Cl.
*F41J 7/04* (2006.01)
*F41J 5/14* (2006.01)

(52) U.S. Cl.
CPC .. *F41J 7/04* (2013.01); *F41J 5/14* (2013.01)

(58) Field of Classification Search
CPC ..... F41J 7/04; F41J 5/14
See application file for complete search history.

(56) References Cited

U.S. PATENT DOCUMENTS 4,588,194 A 5/1986 Steidle
4,807,888 A * 2/1989 Pidde ..... F41J 7/04 273/392
5,263,722 A 11/1993 Rosellen
5,346,226 A * 9/1994 Block ..... F41J 7/04 273/392
6,808,177 B2 10/2004 Dehart
10,139,203 B1 11/2018 Teal
11,566,875 B1 * 1/2023 Spikes ..... F41J 7/04
2004/0195775 A1 * 10/2004 Goldsmith, Jr. ..... F41J 7/04 273/392
2011/0175293 A1 * 7/2011 Brune ..... F41J 7/04 273/406
2016/0076859 A1 * 3/2016 Chester ..... F41J 5/056 273/386
2021/0262771 A1 * 8/2021 Ring ..... F41J 5/14
2021/0267331 A1 * 9/2021 Crye ..... A45C 9/00

* cited by examiner

*Primary Examiner* — Michael D Dennis
(74) *Attorney, Agent, or Firm* — IP Works Law PLLC

(57) ABSTRACT

A remote resetting sports target including at least one target holder comprising a first target holder rotatably secured to a base; at least one target plate comprising a first target plate secured to the first target holder; a rack movably secured to the base; and an actuator secured to the rack, wherein the actuator is configured to move the rack along the base; wherein, when the rack is moved linearly in a first direction by the actuator, the rack is configured to rotate the first target holder and the first target plate into an upright orientation.

19 Claims, 8 Drawing Sheets

REMOTE RESETTING SPORTS TARGET

BACKGROUND OF THE INVENTION

The present invention relates to shooting sports or other targets to be struck by projectiles. More particularly, the present invention provides a sports target capable of being reset via a remote.

There are many sports targets that exist which allow an individual to practice or compete. While there are different categories of targets, one main category is stationary targets. In some instances, these targets are made from paper. In many cases paper targets have the primary drawback of not being able to see the precise hit locations without some sort of optic device. Further, depending on the type of projectile some items may not be able to pierce cardboard backed paper. Without cardboard paper targets are flimsy or cannot be secured in an upright manner.

One solution to paper targets are upright targets made from a material that will issue a percussion sound when struck. These targets also have several flaws. One is that these targets must allow for certain projectiles to pass through them for safety reasons. A projectile that does not pass through may not strike with enough force to create a sound. Further, for precision or competition shooting sports the exact location of a hit may be necessary. With gong targets this may not be possible. It may not be possible to determine when a specific target is struck using these targets.

One solution to this problem is to allow for the targets that are struck to rotate into a downed position. This still leaves much to be desired. First, one issue with knockdown targets is that wind may be able to knock the target down. This means that targets may fall that have not been hit. Another issue is the need to reset targets. In the current art a person will need to reset the target manually.

One method to reset the targets is to walk down range and place the targets in an upright position. This could result in walking significant distances. Another method of resetting targets is to hit a special trigger target. In these scenarios a person will have to use a projectile to hit a special reset target and the primary targets will return to the upright position. This has two flaws. First, a person may accidentally hit the reset target prematurely causing the targets to unwantedly reset. Second, as the primary goal is practice, a less skilled shooter may find it difficult to hit the reset target. This may result in having to reset the target manually in any case.

One solution to reset targets which eliminates the need for a walk is a pull sting. However, this is extremely limited. Targets of a certain weight will be difficult to reset via a string or rope. Further, ropes will be capped at certain distances. This will limit shooters to practicing at short distances in order to ensure the rope reset will still properly function.

The remote resetting sports target not only allows for a user to reset their target from a distance but also adds several components of safety to the shooting sports world. While many precautions are taken at ranges there is still always potential for accidents. Many of these Accidents occur when individuals go to reset or check their targets. By using the remote resetting sports target an individual will not have to move down range. This ensures that less accidents amongst the shooting sports community will occur.

Consequently, there is a need for an improvement in the art of sports targets. The present invention substantially diverges in design elements from the known art while at the same time solves a problem many people face when wishing to target practice without constantly having to walk down range to review or reset their targets. In this regard the present invention substantially fulfills these needs.

SUMMARY OF THE INVENTION

The present invention provides a remote resetting sports target wherein the same can be utilized for providing convenience for the user when target practicing. The remote resetting sports target includes a first target plate. The target plate is secured to a first target holder. The first target holder is rotatably secured to a base. A rack is also movably secured to the base. A power source is secured to the base. An actuator is secured to the rack. The actuator is configured to move the rack along the base. The actuator is also operably coupled to the power source. When the rack is moved in a first direction by the actuator the rack will cause the first target holder and the first target plate into an upright position. A case is used to enclose the base, the rack, and the actuator. A remote is operably coupled to the actuator. The remote will activate the actuator in order to reset the targets.

Another object of the remote resetting sports target is to have the remote wirelessly coupled to the actuator.

Another object of the remote resetting sports target is to have at least a second target plate secured to at least a second target holder, wherein the second target holder is rotatably secured to the base.

Another object of the remote resetting sports target is to have the first target plate removably secured to the first target holder.

Another object of the remote resetting sports target is to have a plurality of legs. The legs are secured to the case such that they are capable of moving from a stored position to a deployed position.

Another object of the remote resetting sports target is to have a sensor. The sensor will detect when a target has been hit.

Another object of the remote resetting sports target is to have a score keeper. The score keeper is operably coupled to the sensor.

Another object of the remote resetting sports target is to have the score keeper operably coupled to a display. When a target is hit the score keeper will add to the score and display it on the display.

Another object of the remote resetting sports target is to have at least one light operably coupled to the power source.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
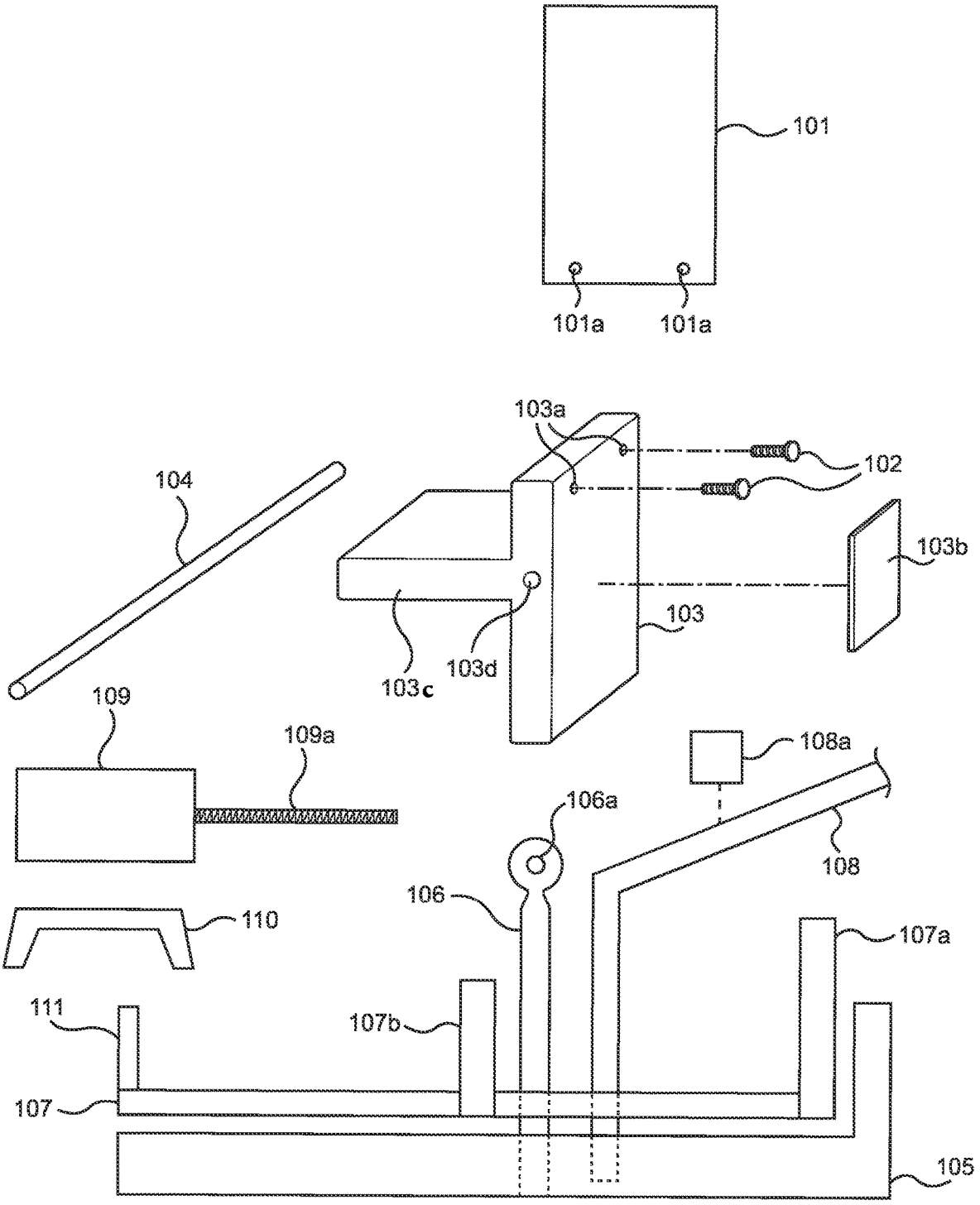
FIG. 1 shows an exploded view of an embodiment of the remote resetting sports target.

With regard to the reference numerals used, the following numbering is used throughout the drawings.

| | |
|---|---|
| 101 | target plate |
| 101a | aperture |
| 102 | fastener |
| 103 | target holder |
| 103a | aperture |
| 103b | plate |
| 103c | lever |
| 103d | aperture |
| 104 | roll bar |
| 105 | base |
| 106 | roll bar support |
| 106a | aperture |
| 107 | rack |
| 107a | first vertical section |
| 107b | second vertical section |
| 108 | cross bar |
| 108a | magnet |
| 109 | actuator |
| 109a | threaded rod |
| 110 | actuator support |
| 111 | push bar |
| 112 | connector |
| 401 | power source |
| 402 | wireless transceiver |
| 403 | kill switch |
| 404 | power button |
| 405 | score keeper |
| 406 | target sensor |
| 407 | display |
| 408 | light |
| 409 | speaker |
| 410 | remote |
| 500 | legs |
| 501 | first portion |
| 502 | second portion |
| 503 | release button |
| 504 | first spring |
| 505 | second spring |
| 506 | case |
| 508 | lid |

DETAILED DESCRIPTION OF THE INVENTION

Reference is made herein to the attached drawings. Like reference numerals are used throughout the drawings to depict like or similar elements of the remote resetting sports target. For the purposes of presenting a brief and clear description of the present invention, a preferred embodiment will be discussed as used for the remote resetting sports target. The figures are intended for representative purposes only and should not be considered to be limiting in any respect.

Referring now to FIG. 1, there is shown an exploded view of an embodiment of the remote resetting sports target. In one embodiment the remote resetting target includes one target. In other embodiments multiple targets are used. In these embodiments each target will be secured to the remote resetting sports target and function in a manner similar to that of the first target.

The remote resetting sports target includes a first target plate 101. In one embodiment the first target plate 101 is made from AR500. In other embodiments the targets are made from other materials. For example, the target 101 will not need to be made from AR500 if the target 101 is intended to be used with an airsoft gun. In this example the target 101 may be made from aluminum or even a strong plastic. Aluminum will allow the device to be light weight while still maintaining structural integrity. This means that the device could be used with all sorts of projectiles without the need to constantly replace the targets 101. In yet another embodiment the targets 101 are stylized targets. This will allow a user to enjoy custom target solutions. In one embodiment the first target plate 101 is fixed to a first target holder 103. In another embodiment the first target plate 101 is removably fixed to the first target holder 103.

In the embodiment where the first target plate 101 is removable fixed to the first target holder 103 the first target plate 101 includes at least one aperture 101*a*. In one embodiment the first target holder 103 will include corresponding apertures 103*a*. In this embodiment fasteners 102 will secure the first target plate 101 to the first target holder 103. In one embodiment the fasteners 102 are screws. In one embodiment the apertures 103*a* of the first target holder 103 are threaded such that the fasteners 102 are directly coupled to the first target holder 103. In another embodiment the fasteners 102 will pass through the first target holder 103 and be secured in a suitable manner. For example, nuts or cotter pins may be used.

In one embodiment a plate 103*b* is secured to the front side of the first target holder 103. The purpose of the plate 103*b* will be described in the description of FIG. 2. In one embodiment a lever 103*c* which is perpendicularly connected to one side of the first target holder 103. In yet another embodiment the first target holder 103 includes an aperture 103*d* which passes longitudinally through the first target holder 103. In one embodiment the aperture 103*d* is adjacent to the position of the lever 103*c*.

In one embodiment the remote resetting sports target includes a roll bar 104. In one embodiment the roll bar will be placed through the aperture 103*d* of the first target holder. The roll bar 104 is used to rotatably secure the first target holder 103 to a base 105 of the remote resetting sports target. In one embodiment the base 105 of the resetting sports target will have at least one roll bar support 106 secured thereto. The at least one roll bar support 106 includes an aperture 106*a* which will allow for the roll bar 104 to be placed therethrough. In one embodiment the base 105 further has a cross bar 108 secured thereto. In one embodiment a magnet 108*a* is secured to the cross bar 108. The cross bar 108 will be further detailed in the description of FIG. 2.

A rack 107 is movably secured to the base. In one embodiment the rack 107 will include a first perpendicular section 107*a*. In one embodiment the first perpendicular section 107*a* will be used to push against the target holder 103 in order to move it into an upright position. In another embodiment the rack 701 includes a second perpendicular section 107*b*. In one embodiment the second perpendicular section 107*b* will engage the lever 103*c* to reset the targets 101. This will be more fully discussing in the description of FIG. 3.

The remote resetting sports target further includes an actuator 109. In one embodiment the actuator 109 is a linear actuator. The actuator 109 includes a threaded rod 109*a*. The actuator 109 will move the rod 109*a* backward or forward using the threaded rod 109*a*. The actuator is secured via an actuator support 110. The actuator support 110 will be coupled to the base 105. In one embodiment the actuator 109 is coupled to a push bar 111. The push bar 111 will then be coupled to the rack 107 such that the rack 107 is moved from a first position to a second position and back by the actuator 109.

Figure 2:
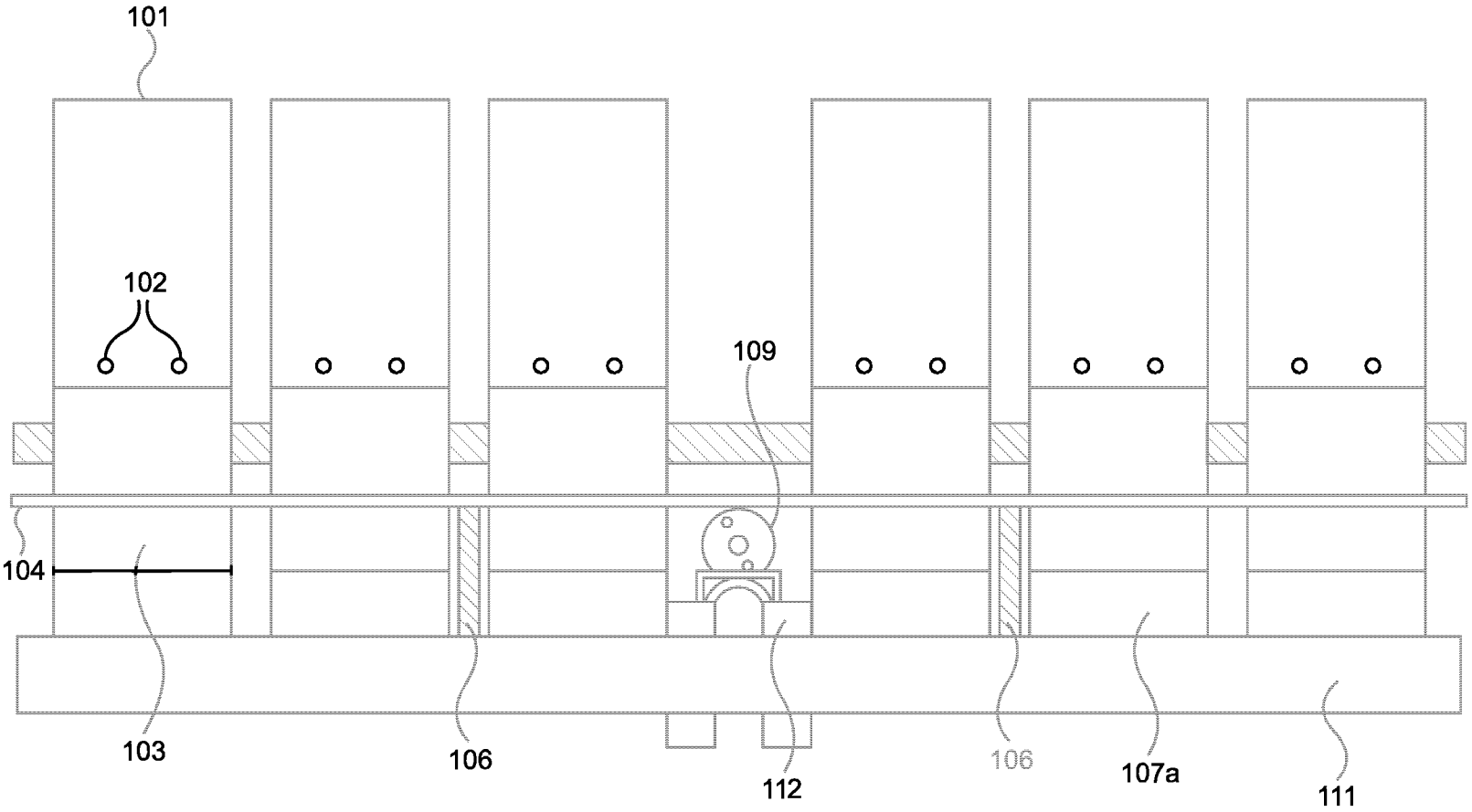
FIG. 2 shows a perspective view of an embodiment of the remote resetting sports target.

Referring now to FIG. 2, there is shown a perspective view of an embodiment of the remote resetting sports target. In this embodiment there is shown multiple targets. Each of these targets includes a target plate 101. In the shown embodiment each target plate 101 is removably secured to a target holder 103 via a plurality of fasteners 102. The roll bar 104 can be seen securing each of the targets 101 to the base 105. In the shown embodiment there are two roll bar supports 106. These roll bar supports 106 are located having an equal number of targets 101 on each side and in between. This will ensure that the roll bar 104 does not become bent.

The actuator 109 is also shown. In this embodiment the actuator 109 is shown in the center of the targets 101. From this location the actuator 109 will be able to apply equal force across the entire device. In other configurations multiple actuators may be used. The actuator 109 is shown secured to the rack 107. The first vertical portion 107*a* of the rack 107 is shown from this view. The actuator 109 is secured to the rack 107 via at least one connector 112. This connector 112 will allow the actuator 109 is capable of moving the rack 107 forward and backward in order to reset the targets 101.

In one embodiment the actuator 109 is connected to a push bar 111 via the at least one connector 112. The push bar 111 will then be connected to the rack 107. In one embodiment there is a rack 107 for each individual target 101. The push bar 111 will move the racks 107 from a first position to a second position to reset the targets 101.

Figure 3A:
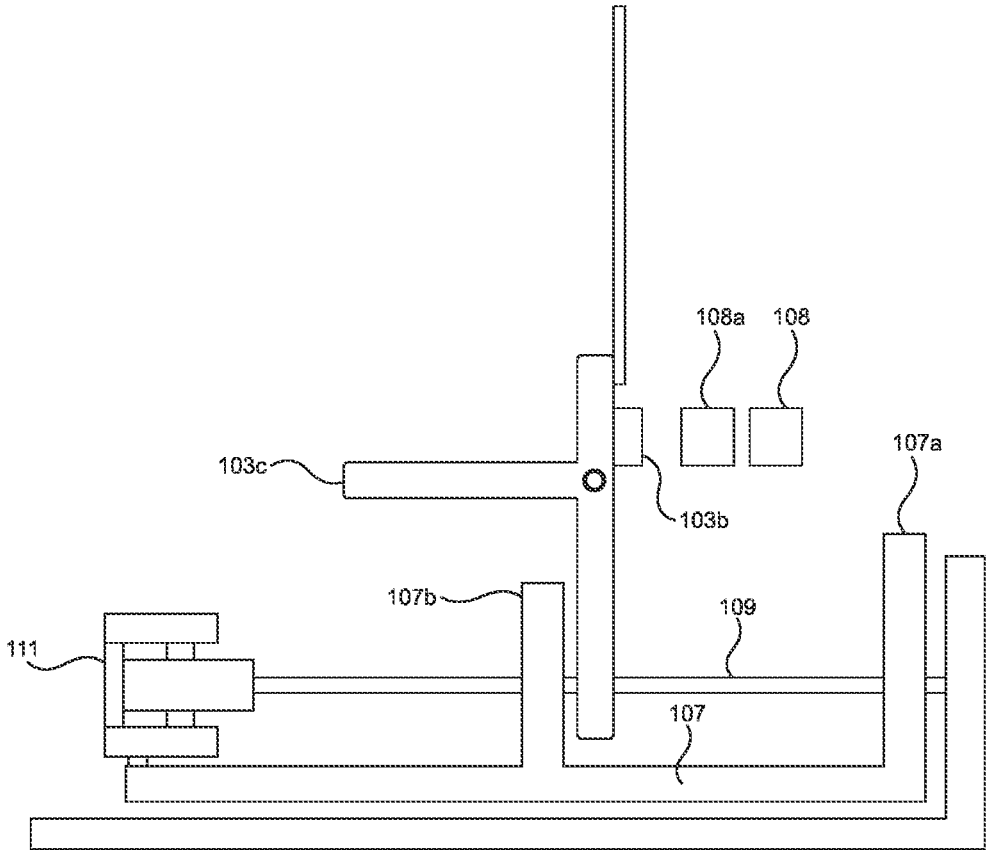
FIG. 3A shows a side view of an embodiment of the remote resetting sports target, where the target is in an upright position.
Figure 3B:
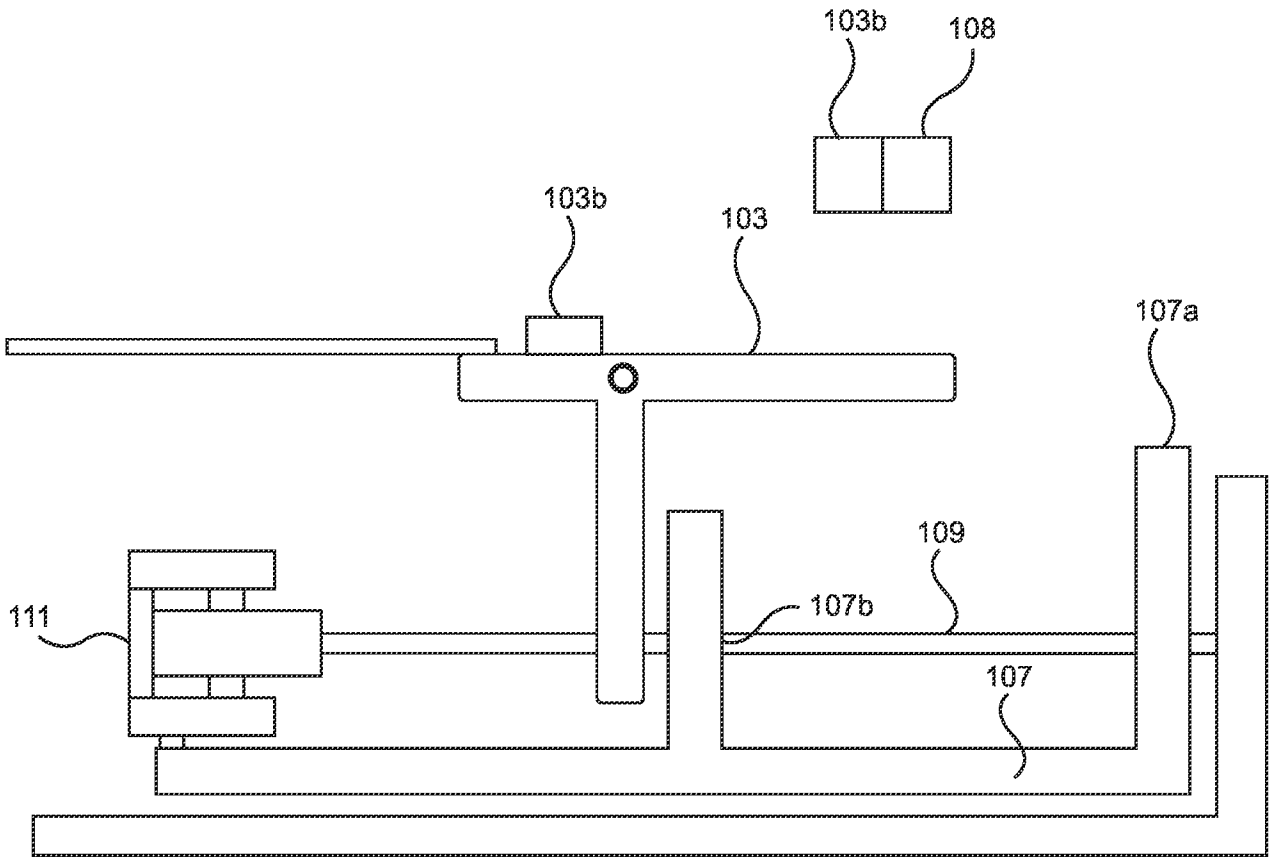
FIG. 3B shows a side view of an embodiment of the remote resetting sports target, where the target is in a down position.
Figure 3C:
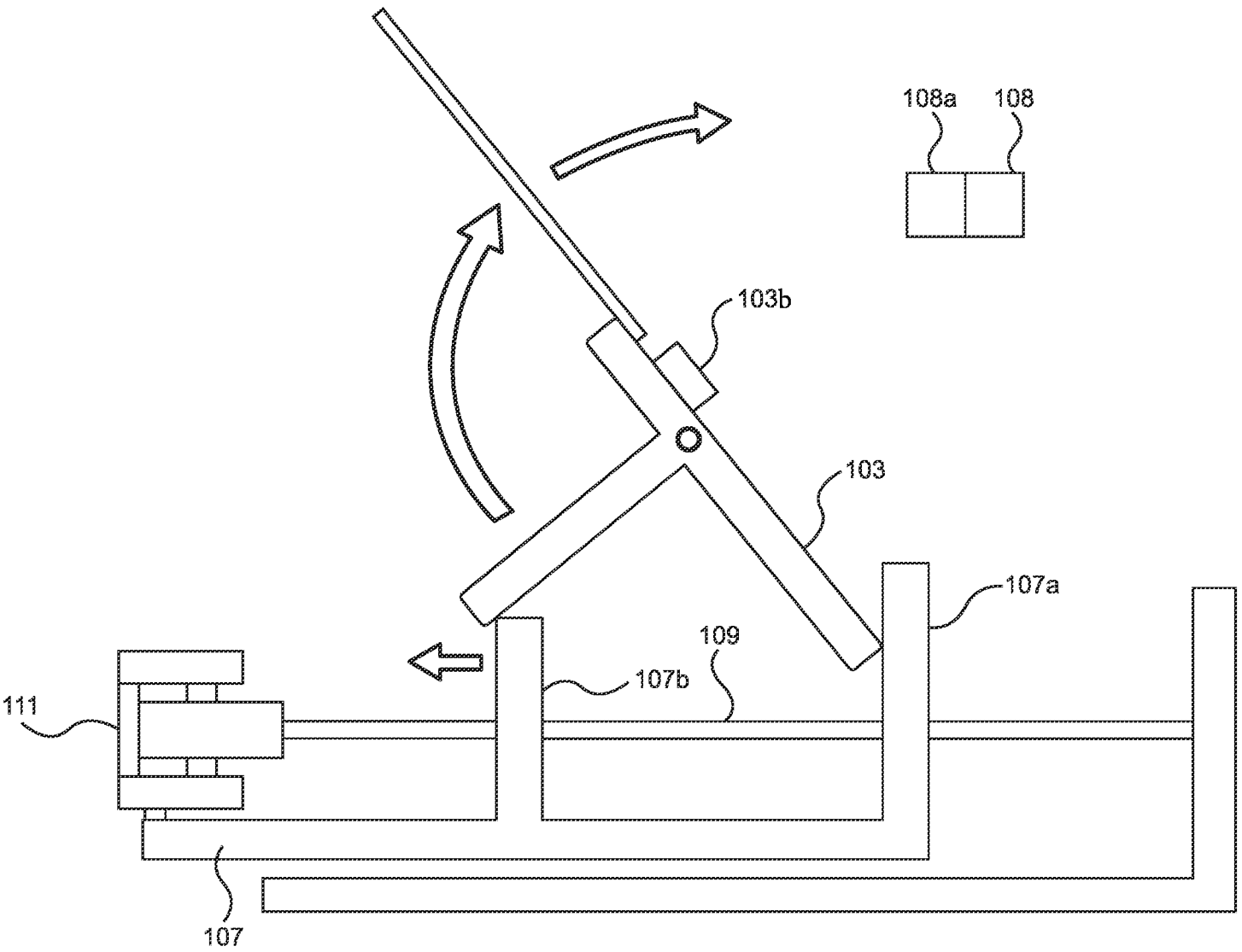
FIG. 3C shows a side view of an embodiment of the remote resetting sports target, where the target is in a resetting position

Referring now to FIG. 3A, FIG. 3B and FIG. 3C, there is shown a side view of an embodiment of the remote resetting sports target with the target in three different positions. In this embodiment the electrical components and the actuator 109 are shown in the rear of the device. This positioning will help to protect them from projectiles accidentally contacting the components. The actuator 109 is then connected to the push bar 111. This will allow for the movements as described below.

In FIG. 3A the target 101 is shown in an upright position. In this view the plate 103*b* is shown in contact with the magnet 108*a*. This will hold the target 101 in an upright position. In this position the target holder 103 is shown between the first vertical portion 107*a* and the second vertical portion 107*b* of the rack 107.

In FIG. 3B the target 101 and the target holder 103 are shown in the down position. The rack 107 is still in the forward position. If the rack 107 would be in the rearward position after the targets 101 are in an upright and set position the target 101 would be locked upright by the first vertical section 107*a*. When the target 101 is in a downed position the lever 103*c* contacts the second vertical portion 107*b* of the rack 107.

FIG. 3C shows the target 101 being moved back to the upright position by the rack 107. When the rack 107 is moved into a rearward position the lever 103*c* will force the target 101 into the upright position by applying pressure from the second vertical portion 107*b* to the lever 103*c*. In one embodiment the rack 107 resets the target 101 the target support 103 will be contacted by the first vertical portion 107*a* of the rack 107. In this embodiment the target 101 will be fully repositioned by the first vertical portion 107*a* after being partially reset by the second vertical portion 107*b*.

Figure 4:
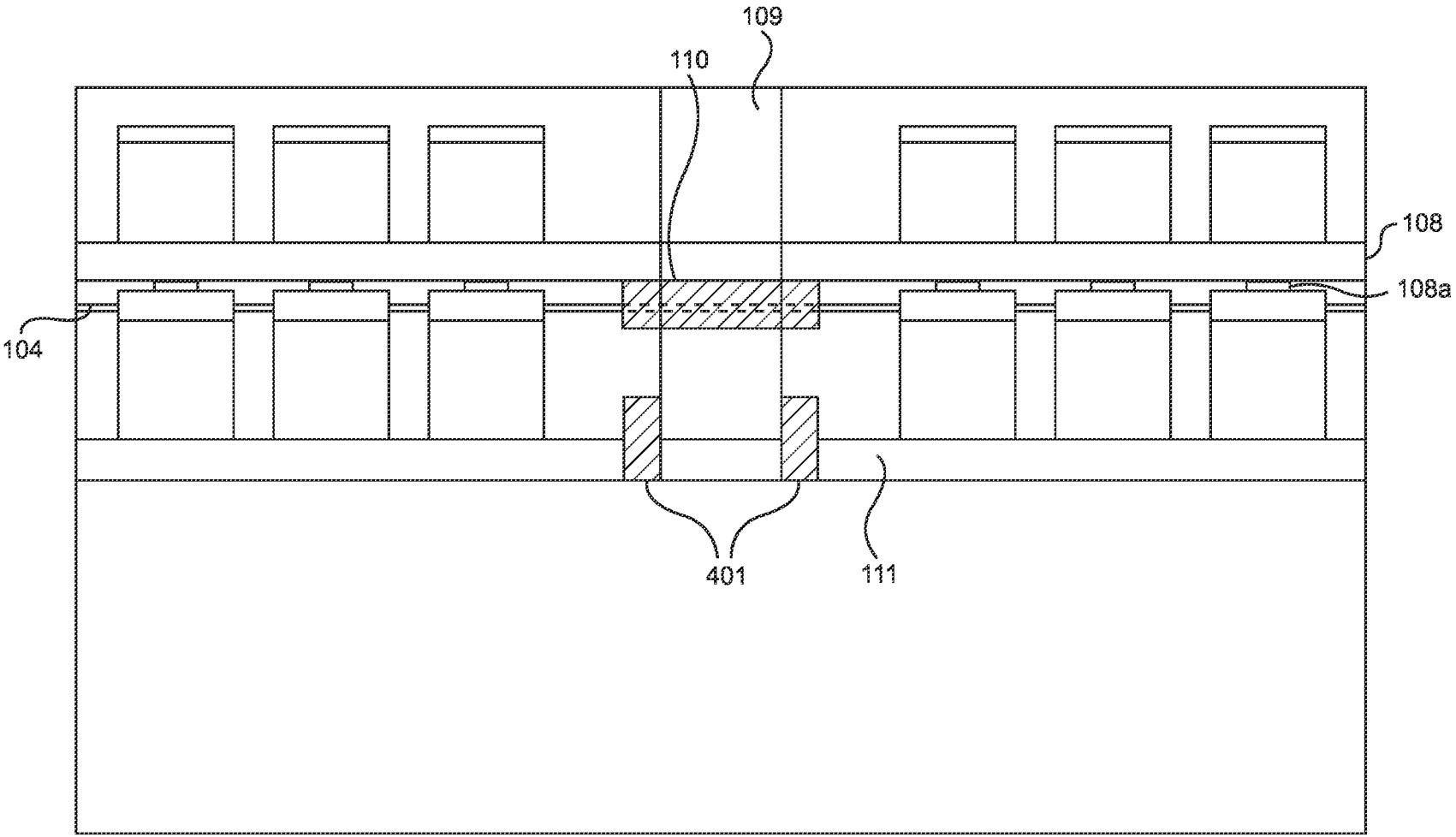
FIG. 4 shows a top-down view of an embodiment of the remote resetting sports target.

Referring now to FIG. 4, there is shown a top-down view of an embodiment of the remote resetting sports target. From this view the connections of the actuator 109 are clearly visible. The actuator 109 is secured to the base 105 via the bracket 110. The actuator 109 is then secured to the push bar 111. The actuator 109 is secured to the rack 107 via a front connection 112. The connection 112 will secure the actuator 109 in a manner which will allow for the connection 112 to function as a buffer. In this manner the device will be able to reset the targets 101.

Figure 5:
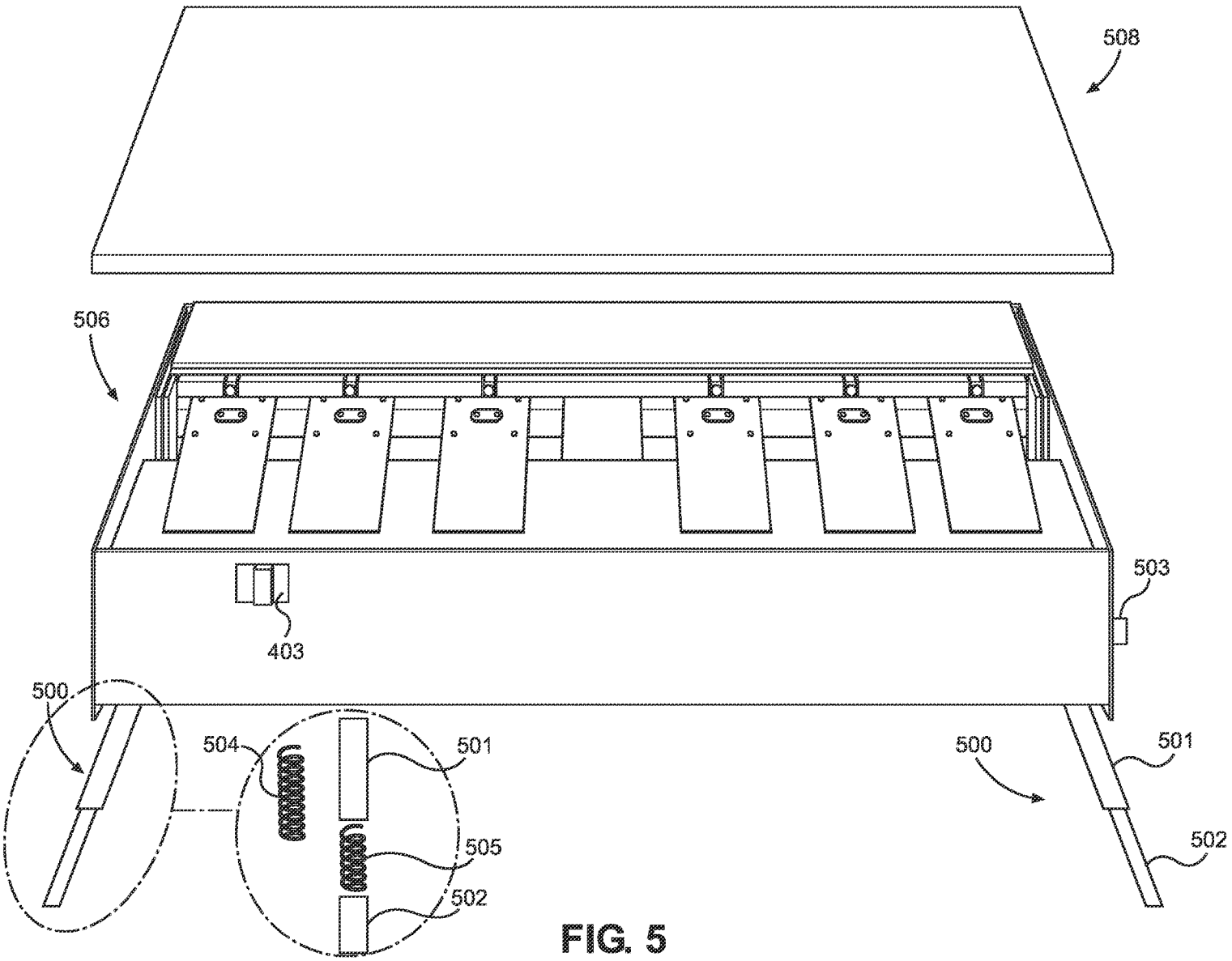
FIG. 5 shows a perspective view of an embodiment of the remote resetting sports target in a case.

Referring now to FIG. 5, there is shown a perspective view of an embodiment of the remote resetting sports target in a case. In one embodiment the sports target is placed within a case 506. The case 506 will allow for the unit to be easily stored and protected. In one embodiment the case is made from a projectile resistant material. The level of protection will vary depending on the intended projectile. For example, a plastic may suffice for an airsoft projectile. However, armor plating may be need for high velocity bullets. In some embodiment the case 506 includes a removable lid 508.

In one embodiment the lid 508 will secure to the case 506 via friction. In another embodiment the lid 508 will secure to the case 506 via buckles. In one embodiment the exterior of the case includes a kill switch 403. The kill switch 403 will cut all power from a power source to the rest of the device. In one embodiment the lid 508 is configured to engage the kill switch 403.

In one embodiment the case 506 includes a plurality of legs 500. The legs 500 will allow for a user to place the device away from the ground. In one embodiment the legs 500 are folding legs. In another embodiment the legs 500 are held in place by a locking device. The locking device is released via a button 503. In one embodiment there is a button 503 adjacent to each leg 500. In yet a further embodiment the legs 500 are spring loaded. In one embodiment a first spring 504 will eject the legs 500 after the button 503 is pressed.

In another embodiment the legs 500 are telescopic legs. In yet a further embodiment each leg 500 is comprised of a first portion 501 and a second portion 502. In yet another embodiment a second spring 505 is housed between the first portion 501 and the second portion 502. This will allow for the legs 500 to be spring activated.

In another embodiment instead of utilizing legs, the device may be positioned on the ground. This will allow for a different height of the target to be maintained. In yet a further embodiment the target box may be buried. This will add yet an additional level of target. Further, by burring the box additional security will be added to the box and its components.

Figure 6:
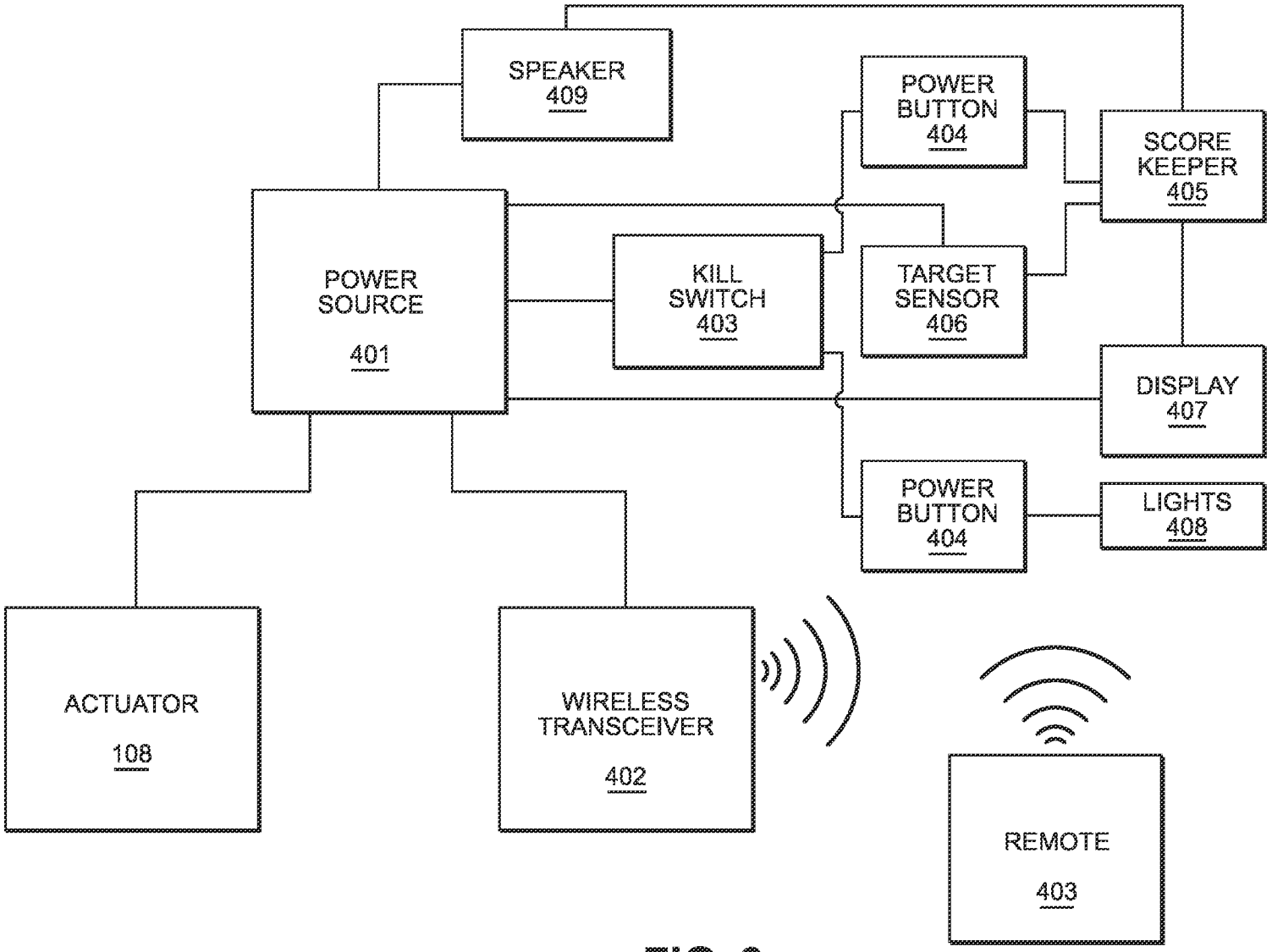
FIG. 6 shows a wiring diagram of an embodiment of the remote resetting sports target.

Referring now to FIG. 6, there is shown a wiring diagram of an embodiment of the remote resetting sports target. The remote resetting sports target includes a power source 401. In one embodiment the power source 401 is a battery. In yet a further embodiment the power source 401 is a rechargeable battery. The power source is operably coupled to the actuator 109.

In one embodiment the power source 401 and the actuator 109 are both operably coupled to a wireless transceiver 402. The wireless transceiver 402 will allow for the remote resetting sports target to be wirelessly connected to a remote 410. In one embodiment the remote 410 will be used to reset the targets 101. In a further embodiment the remote 410 will be connected directly to the actuator 109 via a wired connection. In this embodiment the remote 410 will still be able to activate the actuator 109 resetting the targets.

In one embodiment the resetting sports target includes additional components. In one embodiment a kill switch 403 is connected to the power source 401. As described above in one embodiment the kill switch 403 is engaged by the lid of the case. In this embodiment the when the lid is on the case the kill switch 403 will be engaged. This will prevent power from reaching the components. In another embodiment the kill switch 403 is a switch which may be engaged or disengaged by a user.

In one embodiment the kill switch 403 is operably coupled to at least one power button 404. Once the kill switch 403 is disengaged the power buttons 404 will control the power to the device. In one embodiment a power button 404 is coupled to a score keeper 405. The score keeper 405 will allow for hit targets to be scored. In one embodiment the score keeper 405 is operably coupled to a target sensor 406. The target sensor 406 is also operably coupled to the power source 401. The target sensor 406 will record when a target is hit such that the score keeper 405 can properly keep score. In yet another embodiment the device includes at least one display 407. The display 407 is operably coupled to the power source 401. In this embodiment the score keeper 405 will report the score to the at least one display 407. In one embodiment where there are multiple displays 407 the score keeper 405 will enable multiple scores to be kept and displayed. This will allow, for example, a head-to-head matchup of multiple users.

In one embodiment the display 407 may be wirelessly connected to the device. In yet a further embodiment the display 407 may not be part of the device at all. In this embodiment the display 407 may be part of a smart device such as a tablet or smartphone. In this embodiment the display 407 and smart device may include a mobile application. The mobile application will be capable of displaying the target score information. In yet another embodiment the mobile application will include a leader board and all-time best scores. In a further embodiment the application will allow users to compete without being located in the same physical location.

In yet another embodiment the score keeper 405 is coupled to a speaker 409. The speaker 409 is also operably coupled to a power source 401. In one embodiment the score keeper 405 will send notifications to be played by the speaker 409. In one embodiment the speaker will play the score total. In yet another embodiment the speaker 409 will play a winner notification.

In one embodiment a second power button 404 is included. In this embodiment the power button 404 is operably couple to at least one light 408. In one embodiment the at least one light 408 will highlight the target. In another embodiment the at least one light 408 will be used to enhance the shooting experience.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A remote resetting sports target, the target comprising:
at least one target holder comprising a first target holder rotatably secured to a base, the first target holder comprising a lever;
at least one target plate comprising a first target plate secured to the first target holder;
a rack movably secured to the base; and
an actuator secured to the rack, wherein the actuator is configured to translate the rack along the base;
wherein:
when the actuator translates the rack linearly in a first direction, the rack is configured to rotate the first target holder and the first target plate into an upright orientation, and
the lever is perpendicularly attached to a rear side of the first target holder, and the rack is configured to engage the lever to rotate the first target holder to the upright orientation.

2. The remote resetting sports target of claim 1, further comprising a remote operably coupled to the actuator, wherein the remote is configured to activate the actuator.

3. The remote resetting sports target of claim 2, wherein the remote is wirelessly coupled to the actuator.

4. The remote resetting sports target of claim 1, further comprising a target stop bar, wherein the target stop bar is secured to the base; and
wherein the target stop bar is positioned such that, when the first target holder is in the upright orientation, the first target holder is configured to contact the target stop bar.

5. The remote resetting sports target of claim 4, further comprising a magnet attached to the target stop bar,
wherein, when the first target holder is in the upright orientation, the first target holder is configured to be magnetically secured to the target stop bar.

6. The remote resetting sports target of claim 1, wherein the first target holder is rotatably secured to the base via a roll bar and a bracket.

7. The remote resetting sports target of claim 1, wherein:
the at least one target plate further comprises at least one additional target plate and the at least one target holder further comprises at least one additional target holder,
each additional target plate of the at least one additional target plate is secured to a corresponding additional target holder of the at least one additional target holder, and
each additional target holder of the at least one additional target holder is rotatably secured to the base.

8. The remote resetting sports target of claim 1, wherein the first target plate is removably secured to the first target holder.

9. The remote resetting sports target of claim 1, wherein the first target plate is made from AR500.

10. The remote resetting sports target of claim 1, wherein the first target plate is made from aluminum.

11. A remote resetting sports target, the target comprising:

at least one target holder comprising a first target holder rotatably secured to a base, the first target holder comprising a lever;

at least one target plate comprising a first target plate secured to the first target holder;

a rack movably secured to the base;

a power source secured to the base;

an actuator secured to the rack, wherein the actuator is configured to translate the rack along the base, and wherein the actuator is operably coupled to the power source;

a case which encloses the base, the rack, and the actuator; and a remote operably coupled to the actuator, wherein the remote is configured to activate the actuator;

wherein:

when the actuator translates the rack linearly in a first direction, the rack is configured to rotate the first target holder and the first target plate into an upright orientation, and the lever is perpendicularly attached to a rear side of the first target holder, and the rack is configured to engage the lever to rotate the first target holder to the upright orientation.

12. The remote resetting sports target of claim 11, wherein the remote is wirelessly coupled to the actuator.

13. The remote resetting sports target of claim 11, wherein:

the at least one target plate further comprises at least one additional target plate and the at least one target holder further comprises at least one additional target holder, each additional target plate of the at least one additional target plate is secured to a corresponding additional target holder of the at least one additional target holder, and each additional target holder of the at least one additional target holder is rotatably secured to the base.

14. The remote resetting sports target of claim 11, wherein the first target plate is removably secured to the first target holder.

15. The remote resetting sports target of claim 11, further comprising a plurality of legs secured to the case;

wherein each leg of the plurality of legs is secured to the case such that each leg is configured to move from a stored position to a deployed position.

16. The remote resetting sports target of claim 11, further comprising a sensor, wherein the sensor is configured to detect when a target plate has been impacted by a projectile.

17. The remote resetting sports target of claim 16, further comprising a score keeper, wherein the score keeper is operably coupled to the sensor.

18. The remote resetting sports target of claim 17, wherein the score keeper is operably coupled to a display;

wherein, when the sensor detects that a target plate has been impacted, the score keeper is configured to add to a score that is displayed on the display.

19. The remote resetting sports target of claim 11, further comprising at least one light operably coupled to the power source.

* * * * *